United States Patent [19]

Terhoeven

[11] 3,997,983

[45] Dec. 21, 1976

[54] FOOTWEAR

[76] Inventor: Franz-Josef Terhoeven, Hauptstrasse 32, 4178 Kevelaer, Germany

[22] Filed: May 28, 1975

[21] Appl. No.: 581,581

[30] Foreign Application Priority Data

June 1, 1974 Germany ..... 2426727

[52] U.S. Cl. ..... 36/72 R

[51] Int. Cl.[2] ..... A43B 13/22

[58] Field of Search ..... 36/72 R, 72 C

[56] References Cited

UNITED STATES PATENTS

| | | | |
|---|---|---|---|
| 2,972,824 | 2/1961 | Schlecht | 36/72 R |
| 2,988,829 | 6/1961 | Johnsen | 36/72 R |
| 3,175,292 | 3/1965 | MacQuaid et al. | 36/72 R |
| 3,561,142 | 2/1971 | Streit et al. | 36/72 R |
| 3,798,804 | 3/1974 | Funck | 36/72 R |
| 3,841,004 | 10/1974 | Gray et al. | 36/72 R |

*Primary Examiner*—G. V. Larkin

*Attorney, Agent, or Firm*—Andrus, Sceales, Starke & Sawall

[57] ABSTRACT

In safety footwear, a middle foot protector is provided bridging the middle region of the foot. A resilient lining is disposed under the middle foot protector. The fastening is located beyond and adjacent to the upper end of the middle foot protector and covering one end of the resilient lining so that, when the fastening is tightened, the upper edge of the middle foot protector does not project below the fastening.

10 Claims, 3 Drawing Figures

FOOTWEAR

BACKGROUND OF THE INVENTION - FIELD OF THE INVENTION

This invention relates to footwear, particularly safety boots having a middle foot protector inserted into the upper thereof and supported on a resilient lining.

BACKGROUND OF THE INVENTION DESCRIPTION OF THE PRIOR ART

At present, safety footwear is used extensively in underground mining because of the particularly large number of foot injuries in that industry caused by falling objects.

Therefore, in addition to the said middle foot protector, items of footwear of this type usually have at least a protective toe cap which is also inserted into the upper thereof and which consists for example of steel. The middle foot protector, which can consist either of steel or of a tough, resilient plastic is, however, of special importance. Therefore, it must be ensured that on the one hand the middle foot protector is strong so that it can safely take the loads arising in use without injuries to the foot and on the other hand so formed that it is actually used by the wearer of the footwear. This is particularly difficult to ensure since there is the danger that the middle foot protector may restrict the freedom of movement of the foot in the shoe or boot and may cause points of pressure particularly when the wearer is stooping or kneeling.

According to practical experience known footwear, in which the middle foot protection is arranged outside on the leather upper and is detachably connected to the shoe, does not satisfy these requirements. This is because with this type of footwear, wearing the middle foot protector is placed largely at the discretion of the wearer who usually does without it, because the middle foot protector, which is formed as a stiff cap, is fastened with a strap or clasp and therefore presses on the foot (DBGM U.S. Pat. No. 7, 117,825). Moreover, there is the danger of accidents caused by stumbling because the wearer of the shoe can easily trip on such shoes or boots.

It has already been proposed to provide safety footwear which avoids these disadvantages. The middle foot protector is inserted into the shoe or boot so that the wearer is forced to use it. Moreover, good freedom of movement of the foot in the shoe or boot is combined with provision of an excellent safety device against injuries, due to the presence of a resilient lining which is located underneath the rounded middle foot protector which conforms to the middle foot, as well as due to the existence of a cavity between the part of the upper covering the front of the foot and the middle foot protector, which cavity acts as a safety device against impact.

Until now, such footwear has only been made in the form of rubber boots, in which the middle foot protector is covered by a portion which is joined to the upper by vulcanisation. Rubber boots are commonly used by miners and it is sometimes necessary for them to do so. On the other hand, for the widest of applications, footwear is required particularly in the forms of short boots which are provided with fastenings and which can be manufactured from leather or the known leather substitutes as well as from rubber.

SUMMARY OF THE PRESENT INVENTION

The aim basic to the invention is solution of the problem of maintaining the improvement in safety achieved with the insertion of the middle foot protector into the footwear and the freedom of movement of the foot in the shoe already obtained, even when the shoe has a fastening in its upper part.

According to the invention, there is provided an item of footwear having an upper with a middle foot protector which is inserted into and covered by a portion of the upper which encloses the forward area of the wearer's foot, the edge of the middle foot protector being supported on a resilient lining, and a fastening for the shoe being located beyond and adjacent to the upper end of the middle foot protector and covering the resilient lining.

So long as a shoe or boot according to the invention is not done up and therefore the fastening is not pressed on to the resilient lining, the edges of the middle foot protector lie below the plane of the portion with which the middle foot protector is covered. If, however, the fastening is done up and thus the fastening is pressed on to the resilient lining, then the rear upper edge of the middle foot protector facing the foot rises above the plane of the fastening because the resilient lining yields accordingly. Now the foot can be moved at the ankle joint without hindrance, because the rear upper edge of the middle foot protector can also move above the fastening. As a result, the edge of the middle foot protector is prevented from pressing against the foot when the fastening is tightened, and the shoe or boot can be effectively secured by tightening the fastening as much as desired.

It is a particular advantage of footwear in accordance with the invention that the type of fastening employed is largely descretionary and thus can be implemented according to any of the previously known designs. In particular, laces or clasps or straps can be used for the invention. Such a shoe or boot is thus no different, either in appearance or when putting on or taking off, from shoes without a middle foot protector. Therefore, it is easier to ensure their regular use by miners.

Independently of the type of fastening chosen in each individual case, the resilient lining can consist of several separate parts and also of various materials. In one embodiment of the invention, which is simple to manufacture, the resilient lining is lengthened into the shank of the shoe to provide a part covered by the fastening above the middle foot protector.

The shape of the middle foot protector depends on the technical safety requirements. Therefore, it is practical for example to support the middle foot protector on the protective toe cap, so as to eliminate injuries to the foot between the rear edge of the protective toe cap and the lower front edge of the middle foot protector. However, this can be more easily achieved by inserting the middle foot protector and the protective toe cap jointly into a part of the said portion of the upper. The outward movement, as described above, of the rear edge of the middle foot protector over the fastening plays an important role in allowing mobility of the foot.

In such footwear it is further practical to extend the middle foot protection downwards as far as the sole. Considerable strengthening of the foot protection is thus achieved because indirect support for the lining on the base of the shoe is obtained. For the reasons stated, this does not restrict the wearer's ability to move in the shoe or boot.

BRIEF DESCRIPTION OF THE DRAWINGS

An embodiment shown in the figures of the drawings, will now be described by way of example with reference to the accompanying drawings, in which:-

DETAILED DESCRIPTION OF THE PREFERRED EMBODIMENT

Figure 1:
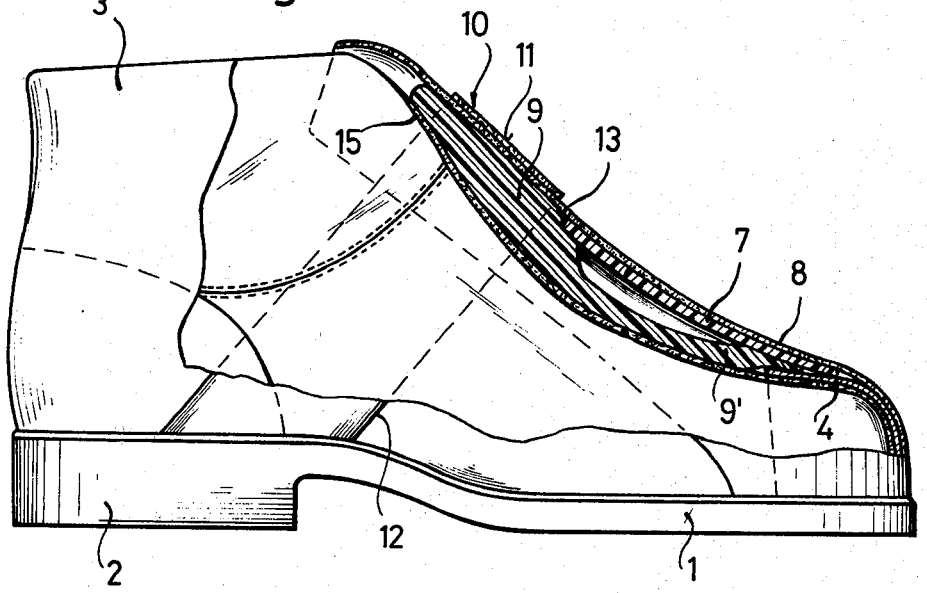
FIG. 1 is a schematic side view in partial section of a short boot according to the invention before the fastening thereof has been tightened.

The short boot illustrated has a sole 1 and a heel 2 as well as a leather upper 3. The boot has a protective toe cap 4 which may be formed by steel. The leather upper runs underneath a middle foot protector 7 consisting of a tough resilient plastic. The middle foot protector 7 may extend as far down as the sole and is covered by a covering 8 under which it is inserted into the boot. Cap 4 and protector 7 may be formed as one piece, if desired.

A resilient lining 9' which is typically coextensive with middle foot protector 7 is disposed under the lower end of the middle foot protector 7. A depression in the lower end of resilient lining 9' forms a cavity beneath middle foot protector 7. Resilient lining 9' is lengthened by an extension 9, which extends under a fastening 10. The fastening consists of two fastening straps 11 fastened to the upper part on the inside and outside, said straps being nipped into the sole of the boot. There are eyelets (not shown) for a known lacing arrangement on the free ends of the straps.

The front edges 12 of the straps, which form the fastening 10 are located beyond the upper end of the middle foot protector 7, near its rear or upper edge 13 which is supported by lining extension 9. The straps 11 also cover the extension 9 of the lining 9'.

Figure 2:
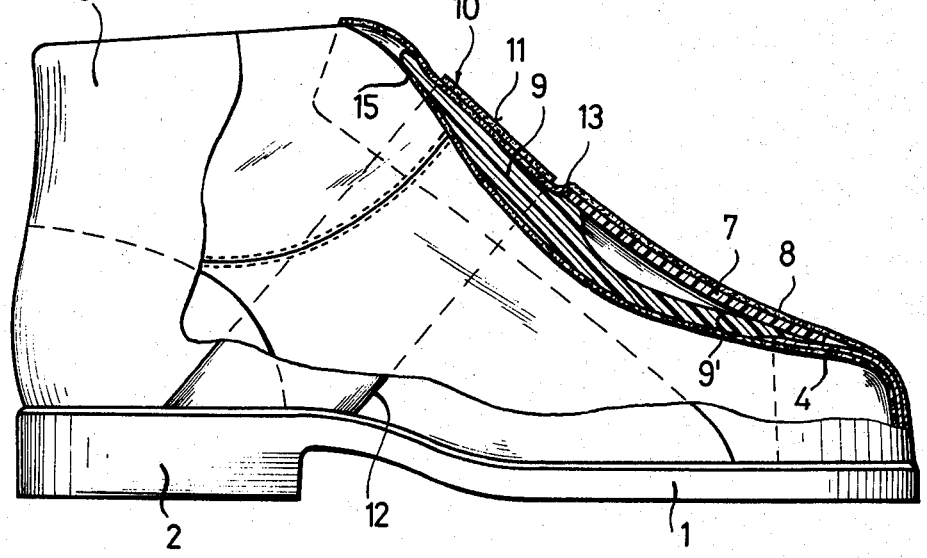
FIG. 2 is a view corresponding to FIG. 1 after the fastening thereof has been tightened.
Figure 3:
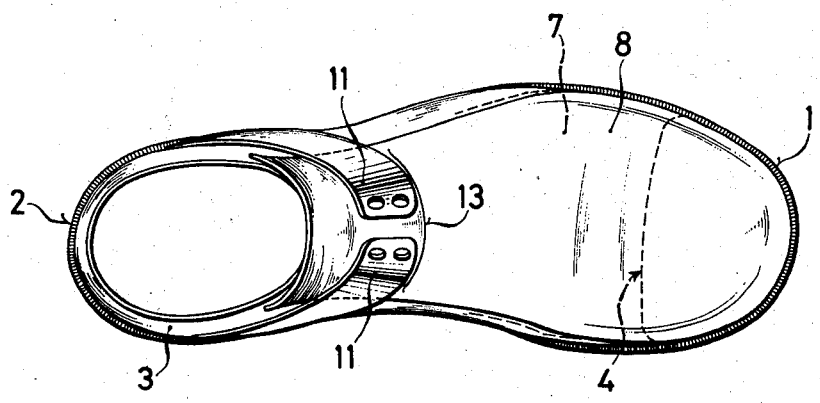
FIG. 3 is a plan view of a short boot according to the invention.

When the fastening 10 is tightened as shown in FIG. 2, the strap 11 presses on to the extension 9 of the resilient lining 9'. This is compressed, causing the rear edge 13 of the middle foot protector 7 to rise with respect to the plane of the upper side of the fastening strap 11 and extension 9 to approach the edge of tongue 15. Consequently when walking, i.e. when the foot pivots, the edge 13 can move freely and is not restrained by strap 11. As a result walking is not hindered.

What is claimed is:

1. A shoe having a sole for receiving the wearer's foot, said sole having an upper portion mounted thereon which encloses the forward area of the wearer's foot; a stiff middle foot protector inserted into, and covered by, said upper portion and positionable above the wearer's foot, said protector having an upper edge; a resilient lining supporting said edge of the middle foot protector; and a fastening means for the shoe anchored in at least one of said sole and upper portion, said fastening means compressively embracing said upper portion beyond but adjacent the upper edge of said middle foot protector.

2. A shoe according to claim 1 in which the resilient lining contains a resilient extension which extends beyond said middle foot protector and under said fastening means, said extenssion being compressible by said fastening means.

3. A shoe according to claim 2 further including a protective toe cap and in which the middle foot protector and the protective toe cap are formed as one piece.

4. A shoe according to claim 1 in which said fastening means consists of strap means having at least an end anchored in said sole or upper portion and having another end which is drawable about the upper portion of said shoe for compressively embracing said upper portion.

5. A shoe according to claim 4 further including a protective toe cap and in which the middle foot protector and the protective toe cap are formed as one piece.

6. A shoe according to claim 1 further including a protective toe cap and in which the middle foot protector and the protective toe cap are formed as one piece.

7. A shoe according to claim 1, in which the middle foot protector extends down as far as the sole.

8. A shoe according to claim 2, in which the middle foot protector extends down as far as the sole.

9. A shoe according to claim 4, in which the middle foot protector extends down as far as the sole.

10. A shoe according to claim 6, in which the middle foot protector extends down as far as the sole.

* * * * *